United States Patent [19]

Hall

[11] Patent Number: 4,804,843

[45] Date of Patent: Feb. 14, 1989

[54] AIMING SYSTEMS

[75] Inventor: Peter R. Hall, Stevenage, United Kingdom

[73] Assignee: British Aerospace Public Limited Co., London, England

[21] Appl. No.: 860,424

[22] Filed: May 7, 1986

[30] Foreign Application Priority Data

May 16, 1985 [GB] United Kingdom ..... 8512441

[51] Int. Cl.[4] ..... H01L 31/00

[52] U.S. Cl. ..... 250/330; 250/334

[58] Field of Search ..... 250/330, 334, 342, 349; 358/113; 42/100

[56] References Cited

U.S. PATENT DOCUMENTS

| | | | |
|---|---|---|---|
| 2,884,829 | 5/1959 | Davies | 356/29 |
| 4,027,159 | 5/1977 | Bishop | 250/342 |
| 4,028,725 | 6/1977 | Lewis | 358/113 |
| 4,168,429 | 9/1979 | Lough | 250/330 |
| 4,220,251 | 4/1980 | Börjesson et al. | 250/330 |
| 4,237,492 | 12/1980 | Roth et al. | 358/113 |

FOREIGN PATENT DOCUMENTS

| | | |
|---|---|---|
| 0100719 | 2/1984 | European Pat. Off. . |
| 2658501 | 6/1978 | Fed. Rep. of Germany . |
| 1605027 | 12/1981 | United Kingdom . |

*Primary Examiner*—Janice A. Howell
*Assistant Examiner*—William F. Rauchholz
*Attorney, Agent, or Firm*—Cushman, Darby & Cushman

[57] ABSTRACT

Aiming system for firearms of the type for use when a target is obscured for example by darkness or camouflage include a sighting arrangement which comprises an imaging device of sufficiently small size to be carried on the firearm. These imaging devices consequently have small apertures and low resolution and are therefore of limited value. The aiming system disclosed herein has an imaging device remote from the firearm which forms a background image of a given field-of-view, the image being displayed on a screen. The system includes a second imaging device carried by the firearm and having a smaller field-of-view corresponding to the line-of-sight of the firearm. The images produced by both imaging devices are correlated by a correlator and a sight-mark is generated in the background image to indicate the line-of-sight of the firearm when correlation is obtained.

3 Claims, 2 Drawing Sheets

AIMING SYSTEMS

This invention relates to aiming systems for firearms, particularly but not exclusively those of a portable nature, such as a rifle, the aiming systems being of the type for use when a target is obscured, for example by darkness or camouflage.

Hitherto such systems have included a firearm and a sighting arrangement comprising an imaging device carried on the firearm which provides an electronically-enhanced image of the scene viewed through the sighting arrangement. Since these imaging devices are of sufficiently small size to be carried on the firearm, they consequently have small aperture, low image enhancement, i.e. low resolution, and are thus of limited value.

It is an object of the present invention to provide a firearm aiming system in which the imaging device is positioned remotely from the firearm that is to say, it is not carried by it, so that its size and weight are not as important. It can therefore have large aperture with consequently high resolution.

However, since the imaging device is remote from the firearm, unlike the arrangement when the imaging device is carried by the firearm, there is no correlation between the field-of-view of the imaging device and the direction of alignment of the boresight of the firearm.

Naturally, the firearm and the imaging device should be slaved together in some way but that requires additional complication. Thus it is a further object of the invention to provide an aiming system in which such correlation is achieved without slaving the imaging device to the firearm.

According to the present invention, there is provided a gun aiming system comprising:

a firearm;

first imaging means having a first field-of-view and forming a first image corresponding to said first field-of-view, the first imaging means being positioned remotely from the gun;

second imaging means having a second field-of-view and forming a second image corresponding to said second field-of-view, the second imaging means being attached to the gun and moving with it, said second field-of-view being relatively smaller than said first field-of-view;

display means for displaying said first image;

correlation means for receiving signals indicative of said first and second images and for producing a correlation signal when said second image correlates with a portion of said first image;

sight-mark generating means for receiving said correlation signal and for generating a sight-mark on said display means corresponding to the position of said second field-of-view within said first field-of-view, whereby subsequent movement of the firearm moves the sight-mark so that the sight-mark can be aligned with a target within said first field-of-view.

Advantageously, said first imaging means is a high resolution thermal imager and said second imaging means is a TV image intensifier.

For a better understanding of the invention, reference will now be made, by way of example, to the accompanying drawings in which.

Figure 1:
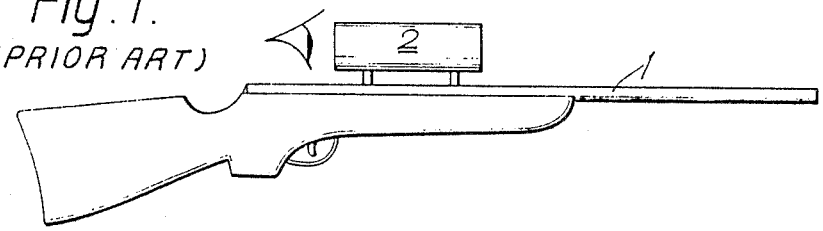
Fig. 1. (PRIOR ART)
FIG. 1 is a schematic diagram of a conventional rifle-aiming arrangement.
Figure 2:
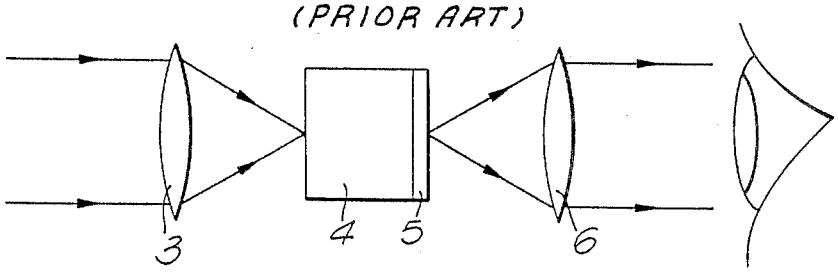
Fig. 2. (PRIOR ART)
FIG. 2 is a detailed diagram of an imaging device used in the FIG. 1 arrangement.

FIGS. 1 and 2 illustrate an aiming system attached to a rifle. A rifle 1 has an imaging device 2 mounted on it in place of a conventional sight eg a telescopic sight. The device 2 consists of a lens 3 which focusses radiation from a viewed scene onto a channel-plate intensifier 4 which has a phosphor-coated screen 5. Another lens or eyepiece 6 is used to view the image on the screen 5, as shown in FIG. 2. This arrangement suffers from poor resolution ie the image produced is not very clear, which is due to the aperture of the device 2 being relatively small, the aperture of the device being related to its size. If a larger apertured device were used, the rifle 1 may become too bulky and cumbersome to be easily utilised.

Figure 3:
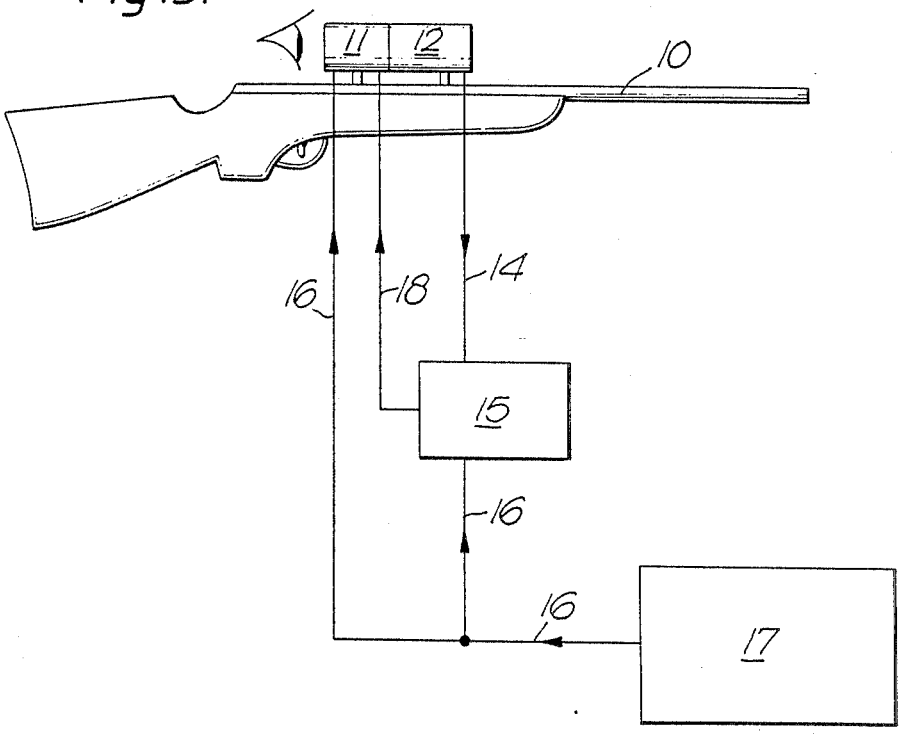
FIG. 3 is a schematic diagram of a rifle aiming arrangement.
Figure 4:
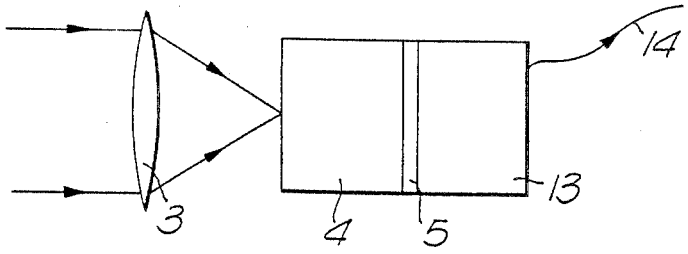
FIG. 4 is a detailed diagram of an imaging device used in the FIG. 3 arrangement.

The arrangement shown in FIGS. 3 and 4 overcomes the problem of poor resolution by incorporating a thermal imaging device. A rifle 10 has a screen 11 and a TV imaging device 12 mounted on it in place of a conventional sight or an imaging device 2. The device 12 is similar to the device 2 in that it consists of a lens 3, an intensifier 4 and a phosphor-coated screen 5. However, a TV pick-up 13 is positioned in front of the screen 5 which provides a video signal 14, the pick-up 13 replacing the lens 6. This signal 14 is passed to a correlator 15. It should be noted that the screen 11 is not the same as the phosphor-coated screen 5 as the screen 5 displays the image viewed through the device 2. The screen 11 receives a video signal 16 from a thermal imaging camera 17 which is positioned remotely from the rifle 10. The video signal 16 corresponds to the field-of-view of the camera 17, and therefore the screen 11 displays an image corresponding to that field-of-view ie a background image. The video signal 16 is also passed to the correlator 15. Naturally, the screen 11 is aligned with the rifleman's eye. Because such an imaging camera is used, a large background image is available to the rifleman, and if switching optics are used an even larger field-of-view may be available. The images will in all cases be more detailed than those available from the normal small field-of-view of a conventional rifle-sight or rifle aiming arrangement. However, the problem with this arrangement is that as the rifle 10 is able to move independently of the camera 17, the rifleman will always view the same image from the remotely positioned camera 17 no matter where he points the rifle 10. In order that the rifleman knows where he is aiming the rifle 10, a sight-mark is electronically generated and superimposed on the background image of the field-of-view on the display screen 11, but this is only done in the following circumstances.

The image produced by the device 12 corresponds to a smaller field-of-view than that of the camera 17 and also has a lower resolution. The correlator 15 is used to obtain a correlation, if any, between the signal 14 and 16 corresponding to the images produced by the device 12 and the camera 17 respectively ie correlation occurs when the image produced by the device 12 falls within the background image which the rifleman views. Once correlatio is achieved, a signal 18 is passed to the screen 11 to generate a sight-mark is generated as previously described. It should be noted that only common background features are necessary for correlation to be achieved.

Figure 5A:
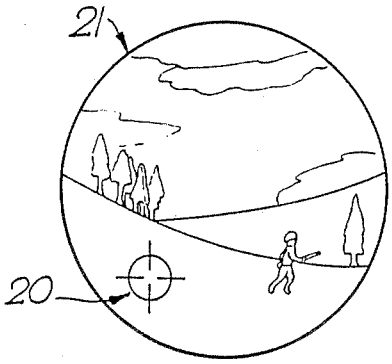
FIGS. 5*a*, 5*b*, and 5*c* show a series of sketches of the image seen by the rifleman with the rifle aligned with the ground, the sky and a target respectively, within the field-of-view of the aiming arrangement.
Figure 5B:
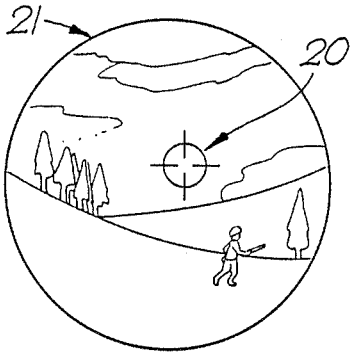
Figure 5C:
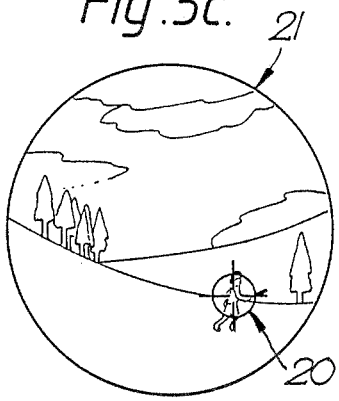

FIG. 5 shows how the image on the screen 11 might appear. A small sight-mark 20 is superimposed on the background image 21, the sight-mark moving with the movement of the rifle 10 and indicates where the rifle is pointing in the viewed scene. In order to aim at a target, the rifleman moves the rifle 10 around until the sight-mark 20 coincides with the image of the target on the screen 11, ie the rifle 10 is lined up with the target as shown in FIG. 5(*c*).

A particular advantage of using a remote camera is that relatively large and heavy imaging equipment can be used. Generally speaking, image intensifiers are convenient because they do not have to be cooled and are small; but in terms of performance they are not as responsive to temperature changes, such changes being the only indication that a well-camouflaged target is present within the field-of-view. Although camouflage at visible wavelengths is easily obtained, it is very difficult to achieve at thermal imaging wavelengths. Thermal imaging apparatus, on the other hand, is generally more sensitive and more responsive to temperature changes but require bulky cryogenic cooling equipment which cannot easily be used when the apparatus is to be mounted on a rifle.

I claim:

1. A vision-enhancing sight for use with a firearm, the sight comprising:

a first opto-electrical image sensor for being mounted on said firearm to form a first video signal representative of the scene within a first field of view which contains the aiming direction of the firearm;

a second opto-electrical image sensor for being placed at a fixed position separate from the firearm to form a second video signal representative of the scene within a second field of view which is larger than and which contains said first field of view;

image display means electrically connected to said second image sensor for displaying an image of the scene represented by the second video signal and operable for being mounted on said firearm for the user to view the displayed image;

correlating means connected to the first and second image sensors and operable for correlating the first and second video signals to determine the position of the first field of view within the second field of view; and sight mark generating means connected to the correlating means and the display means and operable in response to the correlating means for causing said displayed image to contain a sight mark indicative of said aiming direction within the second field of view.

2. A sight according to claim 1, wherein said second image sensor is a thermal imager.

3. A rifle with a night sight comprising:

a high resolution thermal imager which is portable but too large to be sensibly mounted upon the rifle, the imager being operable for being placed near the rifleman to view the overall scene forward of the rifleman's position;

mounted on the rifle, a compact assembly including an operative combination of an image intensifier and a TV camera for producing a relatively low resolution image of a portion of said overall scene containing the point at which the rifle is aimed, and further including a TV display device coupled to the thermal imager for displaying an image of said overall scene to said rifleman; and correlating means connected to said thermal imager, said TV camera and said TV display device for correlating the picture seen by the TV camera with the picture seen by the thermal imager to determine the position of said scene portion within the overall scene and for marking in the displayed image said point at which the rifle is aimed.

* * * * *